US007882768B2

(12) United States Patent
Urquizu Osa

(10) Patent No.: US 7,882,768 B2
(45) Date of Patent: Feb. 8, 2011

(54) MANUAL WRENCH FOR ACTUATING CYLINDRICAL ELEMENTS

(75) Inventor: Ana Urquizu Osa, Vitoria (ES)

(73) Assignee: Egamaster S.A., Vitoria (Alava) (ES)

( * ) Notice: Subject to any disclaimer, the term of this patent is extended or adjusted under 35 U.S.C. 154(b) by 0 days.

(21) Appl. No.: 11/915,917

(22) PCT Filed: Jun. 2, 2006

(86) PCT No.: PCT/ES2006/000324

§ 371 (c)(1),
(2), (4) Date: Nov. 29, 2007

(87) PCT Pub. No.: WO2006/128938

PCT Pub. Date: Dec. 7, 2006

(65) Prior Publication Data

US 2008/0190248 A1 Aug. 14, 2008

(30) Foreign Application Priority Data

Jun. 3, 2005 (ES) ..... 200501337

(51) Int. Cl.
*B25B 13/28* (2006.01)

(52) U.S. Cl. ..... 81/99; 81/111

(58) Field of Classification Search ..... 81/111, 81/186, 92–94, 97–99, 53.2, 441, 185
See application file for complete search history.

(56) References Cited

U.S. PATENT DOCUMENTS

| | | | | |
|---|---|---|---|---|
| 389,685 | A * | 9/1888 | Brock | 81/68 |
| 609,545 | A * | 8/1898 | Hollingsworth | 81/99 |
| 728,945 | A * | 5/1903 | Levy | 81/99 |
| 1,456,620 | A | 5/1923 | Cary | |
| 1,573,409 | A * | 2/1926 | Lynch et al. | 81/186 |
| 2,559,974 | A | 7/1951 | Kunz | |
| 2,649,824 | A * | 8/1953 | Maxwell | 81/99 |
| 2,713,280 | A * | 7/1955 | Larson | 81/99 |
| 2,875,659 | A | 5/1956 | Haberle | |
| 2,958,246 | A | 11/1960 | Osborn | |
| 4,452,108 | A * | 6/1984 | Irwin et al. | 81/96 |
| 6,761,089 | B2 * | 7/2004 | Bergamo | 81/53.2 |
| 6,971,288 | B2 * | 12/2005 | Wei | 81/99 |
| 7,044,030 | B2 * | 5/2006 | Chartier et al. | 81/99 |
| 7,104,163 | B2 * | 9/2006 | Hu | 81/124.3 |

FOREIGN PATENT DOCUMENTS

| | | | |
|---|---|---|---|
| WO | WO03033214 | Y | 4/2003 |

* cited by examiner

*Primary Examiner*—Hadi Shakeri
(74) *Attorney, Agent, or Firm*—Lucas & Mercanti, LLP

(57) ABSTRACT

The invention relates to a manual wrench for actuating cylindrical elements. The inventive wrench comprises a fixed jaw (1) and a moving jaw (3) which are disposed on one end of a handle (2), whereby the fixed jaw (1) is secured with a transverse keyed assembly. The invention also includes an elastic pin (5) which extends through said keying. Moreover, the face of the fixed jaw (1) that faces the moving jaw (3) is equipped with a toothed section (7) comprising identical teeth which extend along a curved zone such as to define a single arc.

12 Claims, 10 Drawing Sheets

MANUAL WRENCH FOR ACTUATING CYLINDRICAL ELEMENTS

FIELD OF THE INVENTION

The present invention is related to quick-action wrenches used to actuate cylindrical elements, such as pipes or the like, proposing a wrench which, as a result of its constructive features, is truly advantageous for said function.

STATE OF THE ART

Wrenches for actuating cylindrical elements, referred to as quick wrenches, are known formed by a handle having at the upper part a fixed jaw and, articulated to the handle, a moving jaw which is actuated by a spring towards the closed position against the fixed jaw.

Known solutions of said wrenches are, for example, the wrench of patent documents US 2003/0209109 and US 2002/0121162, in which the fixed jaw is formed by a toothed member coupled on the body of the handle by means of securing with screws, which requires the machining of boreholes and threads which increase manufacturing costs, as well as being a type of securing that can break.

The spring acting on the moving jaw is further arranged in those embodiments in a complicated assembly due to the difficulty of accessing the securing points of the spring inside the wrench, whereas in the solution in US 2003/0209109 the spring is biased on the mentioned moving jaw, being in a position in which during use of the wrench it may sustain catches and blows with the risk of the accidental disassembly or breakage.

In addition, the mentioned wrenches are provided with the ability to act on cylindrical elements having different diameters, requiring for the effectiveness the action that the teeth of the member act as perpendicular as possible on the element they are applied to, which is conventionally solved by providing the teeth of the member with different sizes and with different inclinations, combined with a shape of the part in which the toothed section is configured with successive arched areas having different radii, making the manufacture thereof even more complicated.

OBJECT OF THE INVENTION

According to the invention, a wrench is proposed that is of the type indicated and which has been developed according to constructive and functional features making it advantageous compared to already known conventional solutions of these wrenches.

Said wrench object of the invention in turn consists of a fixed jaw and a moving jaw incorporated on an actuating handle, whereby the moving jaw is articulated on an axis with a spring actuating towards the closed position of the wrench.

According to the invention the fixed jaw is formed by a member coupled to the body of the handle of the wrench by means of a transverse keyed fitting, securing the retention in the front direction, including an elastic pin traversing the keying, thus preventing mobility towards the sides, whereby it is a completely immobile and very resistant assembly of the member.

The side retaining pin of the member forming the fixed jaw is included through a through hole from the front to the rear part of the coupling area, being open on the two ends, which allows the extraction of the pin by means of a simple push from the rear part, by means of a rod or similar means, for the disassembly of the member when needed.

Said member of the fixed jaw is provided in this case with a toothed section defined in an extension determining a single arc, in combination with teeth which all have identical angles between their two faces, which allows an action with perpendicular incidence on cylindrical elements with different diameters when using the wrench.

Said arc of the toothed section of the fixed jaw is defined by a radius with a measurement between 15 and 35 millimeters, whereas the center of the arc is at a distance from the center of the axis of rotation of the moving jaw comprised between 20 and 57 millimeters, such that this distance is gradually reduced as the radius of the arc increases, which is in turn reduced as the size of the wrench increases.

Longitudinal incision is further provided in the mentioned toothed area of the fixed jaw by means of at least one groove dividing the teeth into partial sections, which favors the effect of attaching said teeth on the cylindrical elements actuated with the wrench, making the grip of the wrench on such cylindrical elements it is applied to more effective. An accessory element can further be incorporated in the dividing groove or grooves of the toothed section so as to adapt the use of the wrench for other types of cylindrical elements to be applied to.

The moving jaw additionally is equipped with side recesses in which the spring acting thereon is housed, which spring is arranged in the assembly such that it is completely housed in said recesses, without projecting outside, whereby preventing catches and blows from being able to affect the spring while the wrench is being used. Said spring is further incorporated in the assembly according to an arrangement which allows easy access to the securing points of the spring, whereby the assembly is very simple.

An in other matters, the structural assembly of the wrench determines in the rear part of the coupling area of the fixed jaw a supporting stop of the moving jaw, preventing said moving jaw from being supported on the teeth of the fixed jaw and being able to deteriorate them when closing the wrench.

The mentioned wrench object of the invention therefore has clearly advantageous features, having its own identity and preferred character in relation to conventional wrenches of the same type.

DETAILED DESCRIPTION OF THE INVENTION

Figure 1:
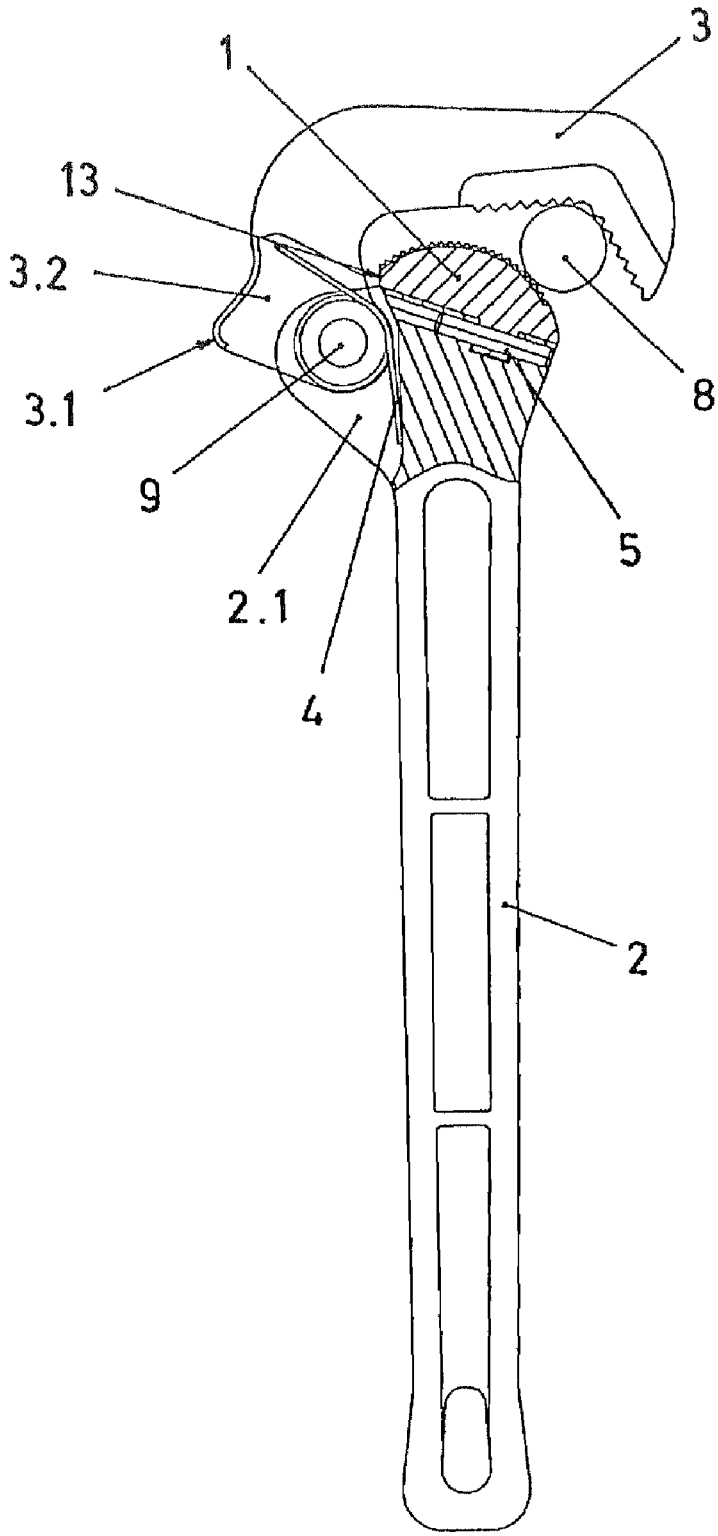
FIG. 1 shows a side view of the proposed wrench with a partial cut-away section in the jaw assembly area, in the position for acting on a cylindrical element having little diameter.
Figure 2:
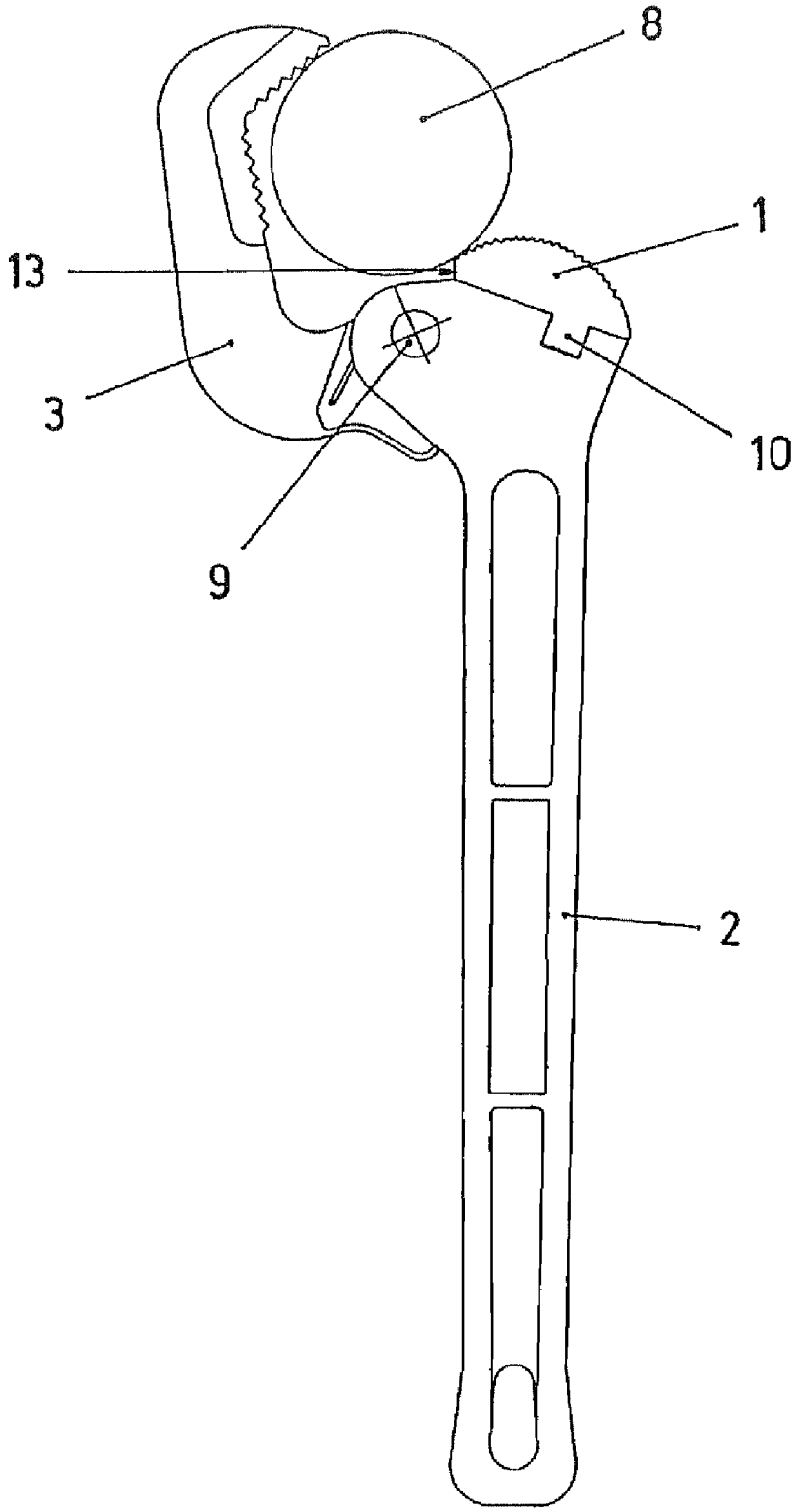
FIG. 2 shows a side view of the wrench in the position for acting on a cylindrical element having a large diameter.
Figure 3:
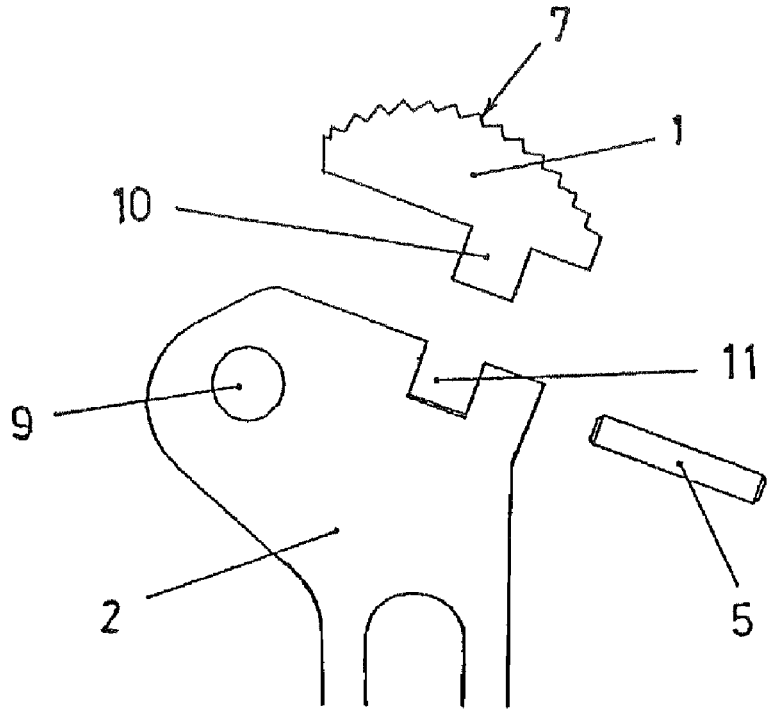
FIG. 3 shows an exploded detail of the arrangement of the fixed jaw assembly of the wrench.
Figure 4:
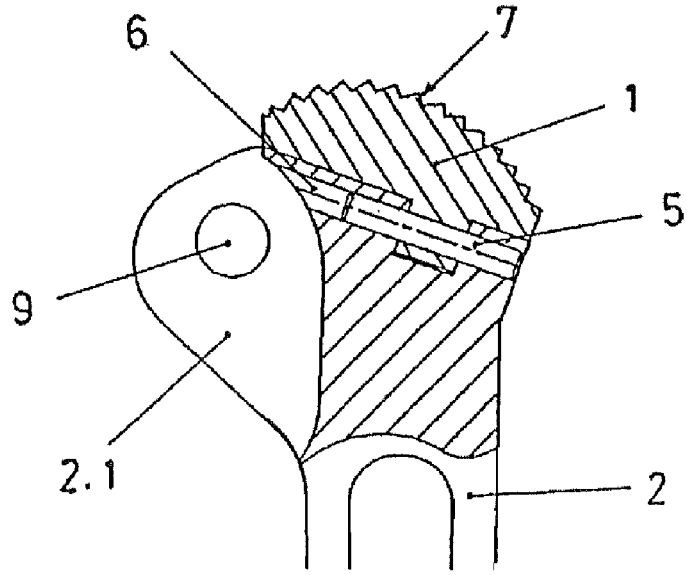
FIG. 4 shows a detail of the same preceding assembly in the assembled position and with a cut-away section in order to see the assembly.
Figure 5:
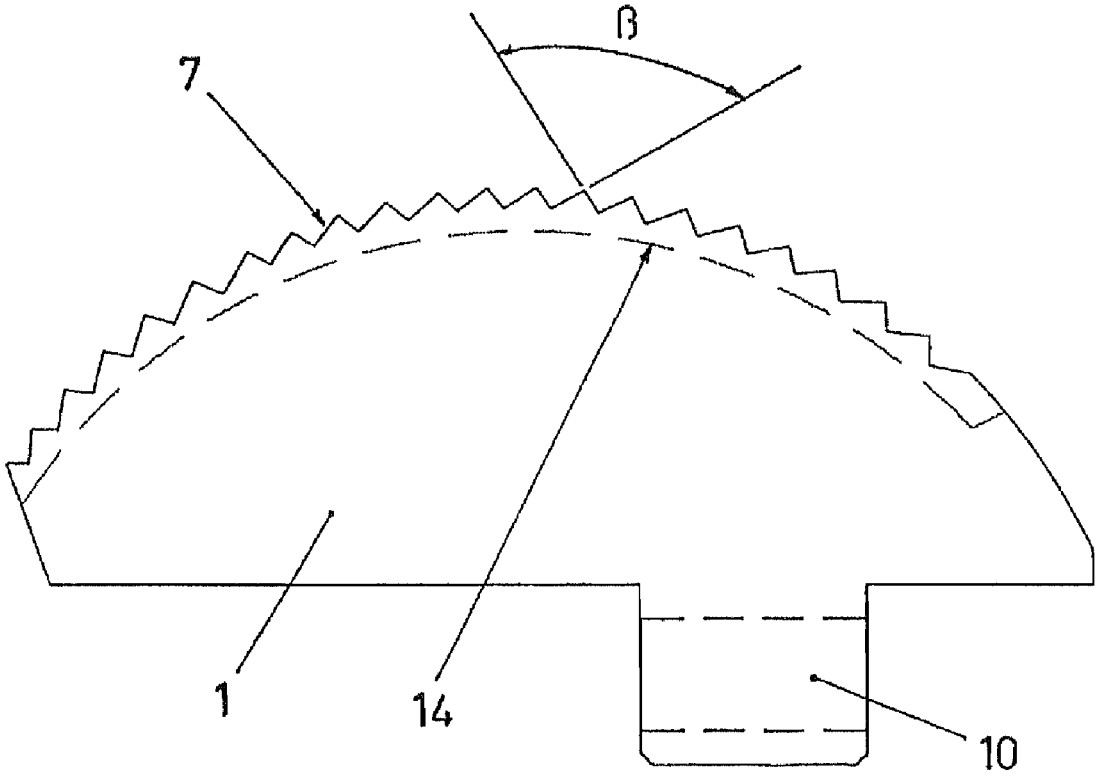
FIG. 5 is an enlarged detail of the fixed jaw of the wrench, seen from a side view, with reference of the angle of the teeth of the toothed section.
Figure 6:
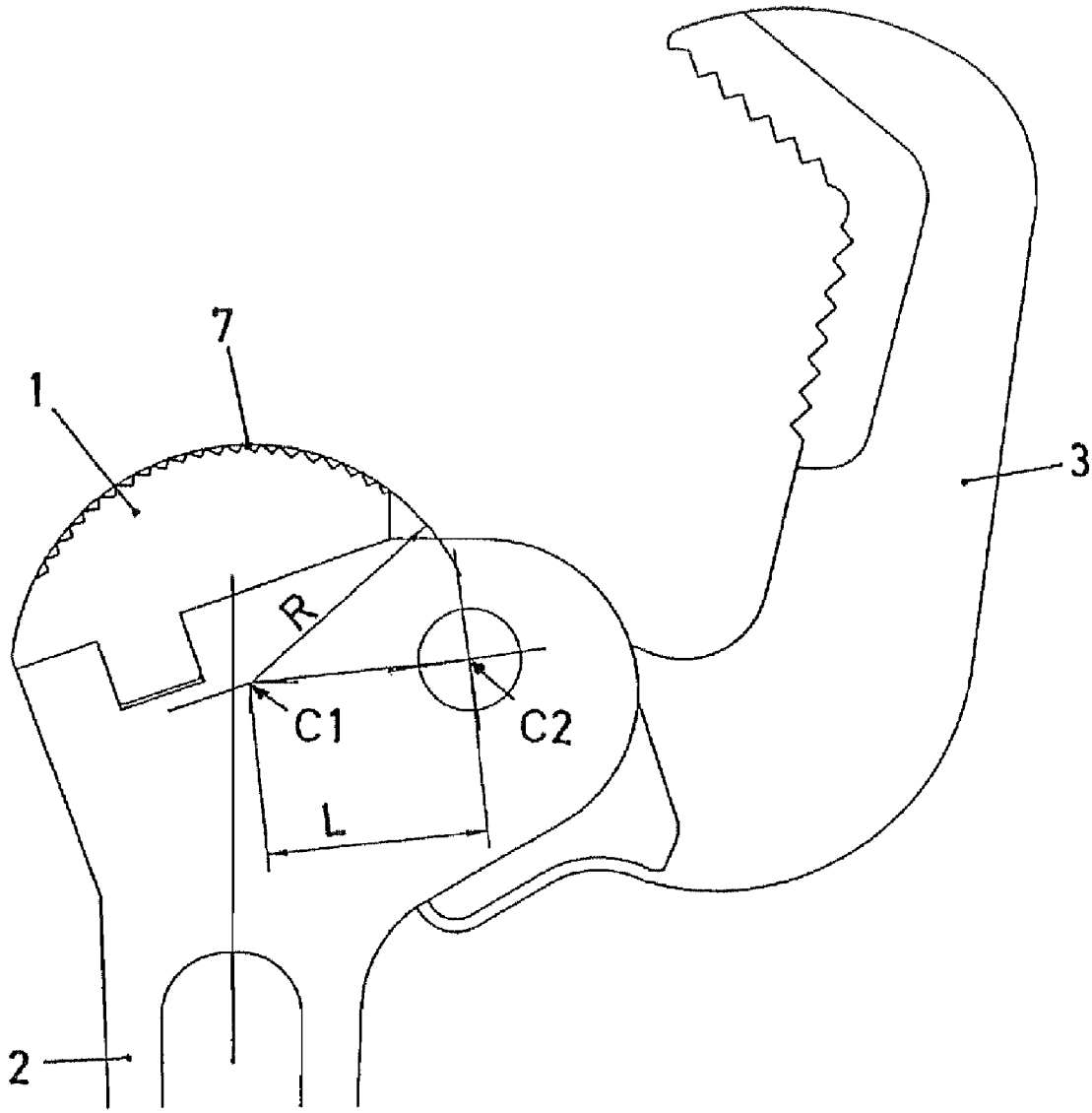
FIG. 6 shows a detail of the end part of the wrench in which the jaws are arranged, with references of the radius and of the center of the arc of the fixed jaw.

The object of the invention relates to a manual wrench manual for actuating cylindrical elements, such as pipes or the like, which due to its constructive and functional features is truly advantageous for this application.

The proposed wrench consists of a fixed jaw (1) formed by a member coupled on the end of an actuating handle (2), and a moving jaw (3) articulated on the same end of the handle (2), including a spring (4) actuating the mentioned moving jaw (3) towards a closed position on the fixed jaw (1).

The securing of the fixed jaw (1) to the handle (2) is formed by means of a transverse keyed fitting securing the retention in the frontal direction, including a pin (5) traversing said keyed coupling, such that it prevents lateral shifting.

To that end, the member forming the fixed jaw (1) determines in the lower part, a key-shaped formation (10) introduced in the assembly in a housing (11) of the end of the handle (2), such that by means of the later insertion of the pin (5) in a corresponding hole (6) the assembly of the mentioned fixed jaw (1) is perfectly secured in a very resistant manner.

The pin (5) is inserted in a hole (6) going from the front part to the rear part of the handle (2) in the coupling area, such that the insertion of said pin (5) is easily carried out through the front part in order to carry out the assembly, allowing the extraction by means of a push with a rod or similar means from the rear part for the disassembly of the fixed jaw (1) when needed.

On the upper face, the mentioned fixed jaw (1) is equipped with a toothed section (7) teeth of which have an angle (β) between their faces that is the same in all of them, preferably 93 degrees, said toothed section (7) being comprised in a curved extension of a single arc which, combined with the angle (β) of the teeth, makes the teeth act perpendicularly in any open position of the wrench on the corresponding cylindrical elements (8) they are applied to.

The arc of the toothed section (7) is defined by a radius (R) the measurement of which is comprised between 15 and 35 millimeters, and preferably between 20 and 31 millimeters, depending on the size of the wrench, such that said radius (R) is reduced as the size of the wrench increases, the center (C1) of the mentioned arc being at a distance (L) from the center (C2) of the axis of rotation (9) of the moving jaw (3), comprised between 20 and 57 millimeters, such that this distance (L) increases as the radius (R) is reduced.

Taking into account that the size of these wrenches is determined by the length thereof in inches, practical examples of wrenches carried out with the previously indicated features are detailed below for non-limiting purposes:

Ten-inch wrench, with a radius (R) of 29.65 millimeters, in which the distance (L) is of 21.53 millimeters.

Ten-inch wrench, with a radius (R) of 30.68 millimeters, in which the distance (L) is 21.48 millimeters.

Fourteen-inch wrench, with a radius (R) of 27.8 millimeters, in which the distance (L) is 26.03 millimeters.

Eighteen-inch wrench, with a radius (R) of 25 millimeters, in which the distance (L) is 44.45 millimeters.

Eighteen-inch wrench, with a radius (R) of 20 millimeters, in which the distance (L) is 49.21 millimeters.

Figure 7:
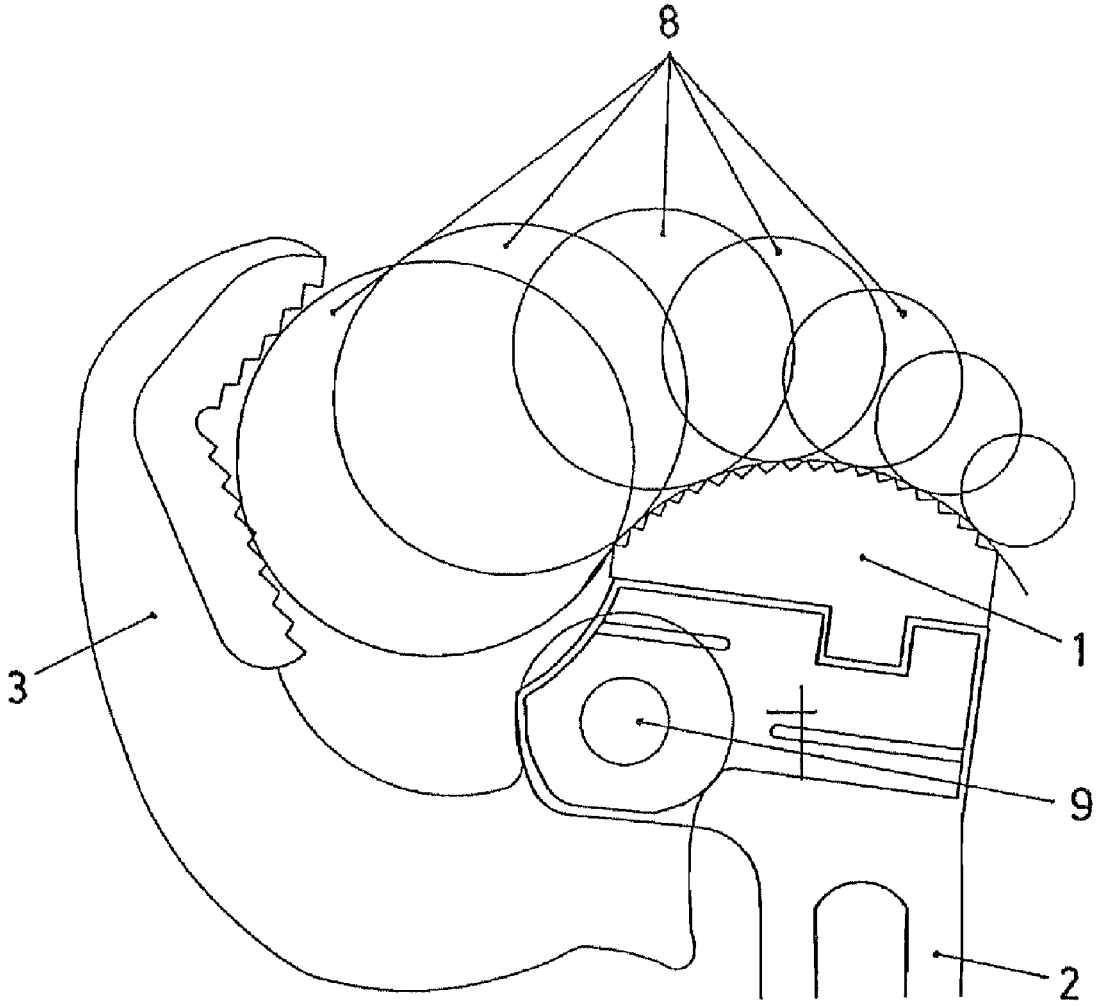
FIGS. 7, 8 and 9 show details of the ability of the wrench to act on cylindrical elements having different diameters, in relation to a ten-inch wrench, a fourteen-inch wrench of and an eighteen-inch wrench, respectively.
Figure 8:
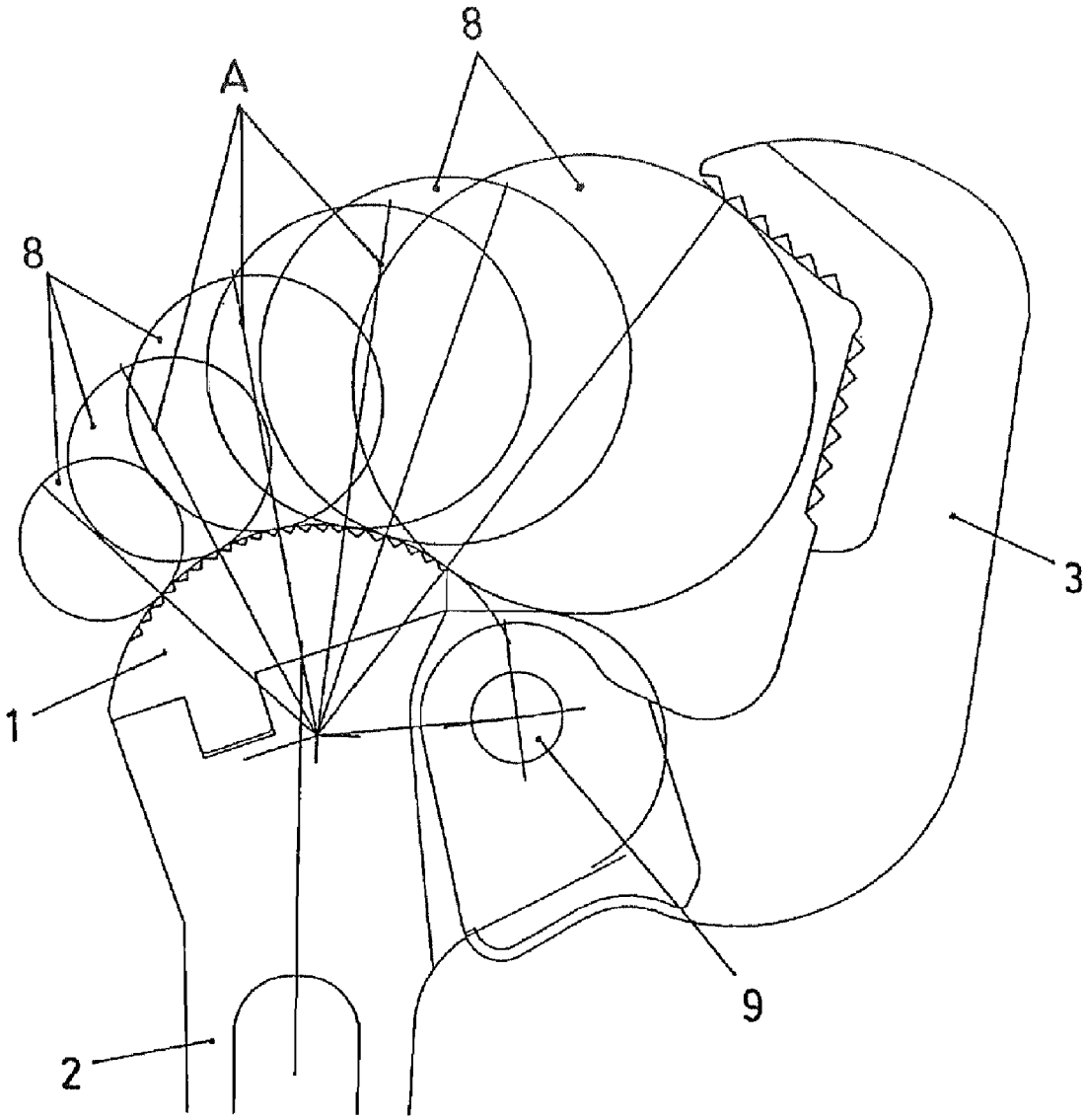
Figure 9:
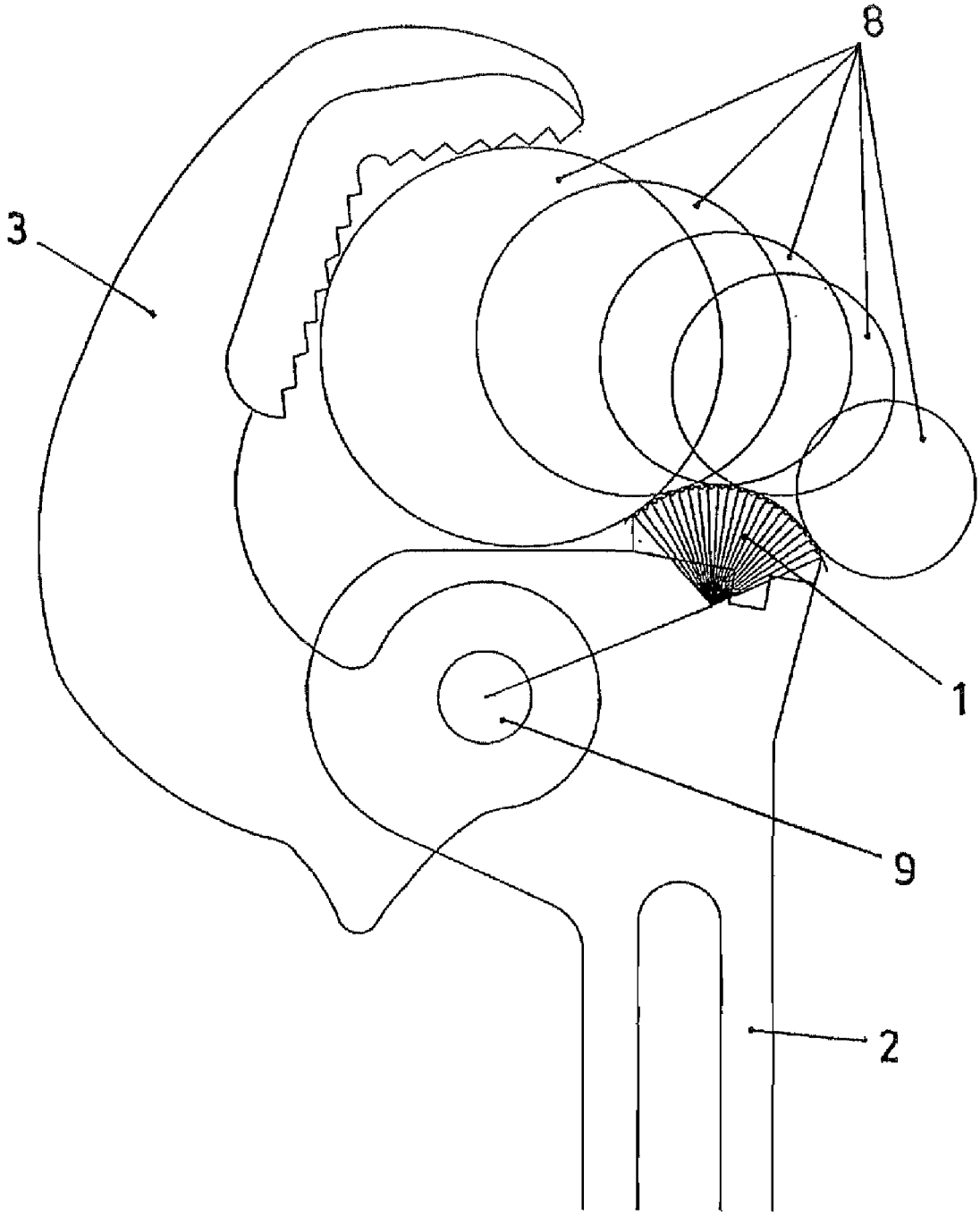

In FIGS. 7, 8 and 9, showing, respectively, a ten-inch, a fourteen-inch and an eighteen-inch wrench, it can be seen that each of these wrenches is effective for a series of cylindrical elements (8) having different diameters, noting in FIG. 8 that the vertex of the angle formed by the toothed section of the moving jaw (3) is on the same side as the axis of articulation (9), with regard to line (A) passing in each case through the center (C1) of the arc of the toothed section (7) of the fixed jaw (1) and through the center of the cylindrical element (8) it is applied to, which condition must be met for the actuation of the wrench to be effective on the elements (8) it is intended for.

Taking into account that the configuration of an arc is defined by a composition of infinite straight successive sections, the toothed section (7) of the fixed jaw (1) can be formed, in complying with the premises of all that which has been previously indicated, by a series of straight sections according to a series of angles the vertices of which define the curve of the arc of said toothed section (7), in this sense a positive result being given with a composition of six or more consecutive straight sections.

A division is further provided in the toothed section (7) of the fixed jaw (1) by means of at least one longitudinal groove (14), whereby the teeth of said toothed section (7) are divided into separate sections, improving the effect of attaching on the cylindrical elements (8) they are applied to since the smaller length of the sections of the complete teeth favors said effect of attaching on the cylindrical elements (8) they are applied to, therefore obtaining greater effectiveness of the wrench in the practical function of its application.

Figure 10:
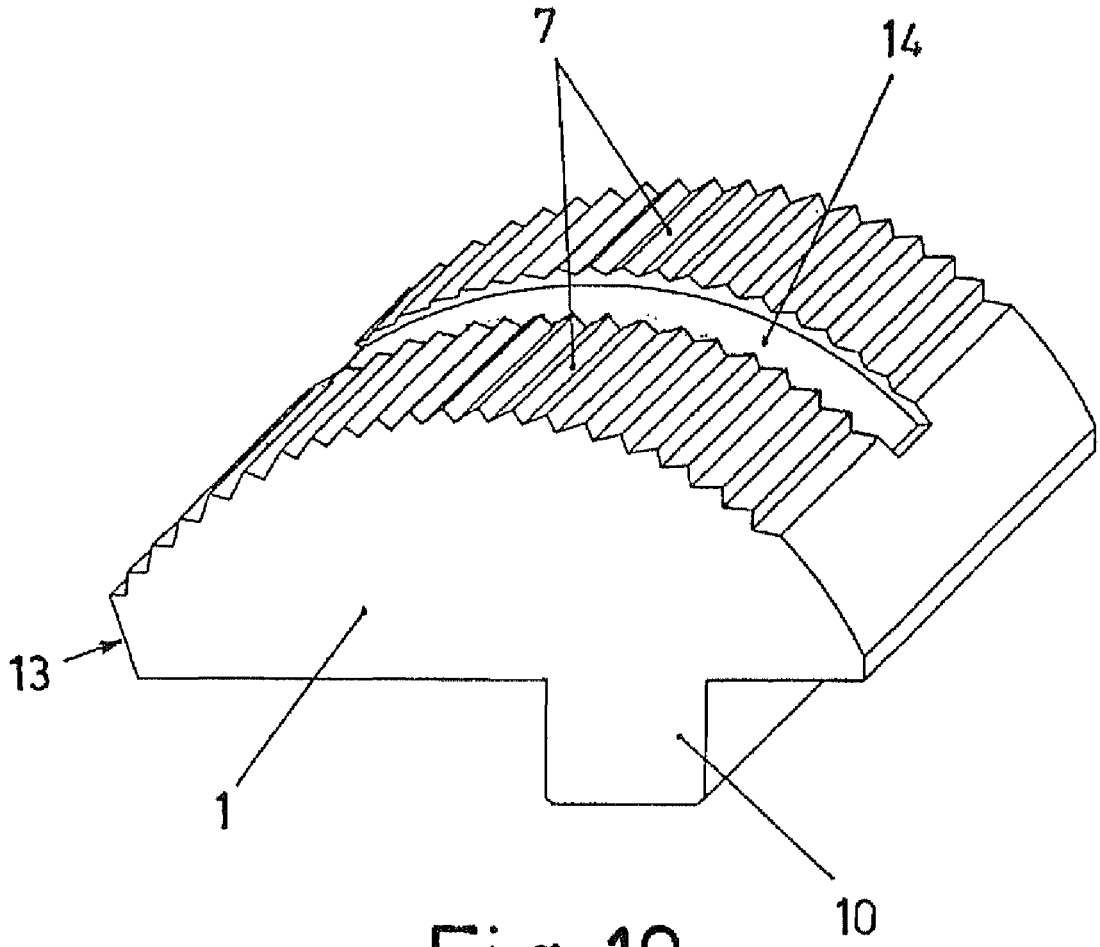
FIG. 10 shows a perspective view of the fixed jaw of the wrench, in which the division of the toothed section by means of a longitudinal groove can be seen.
Figure 11:
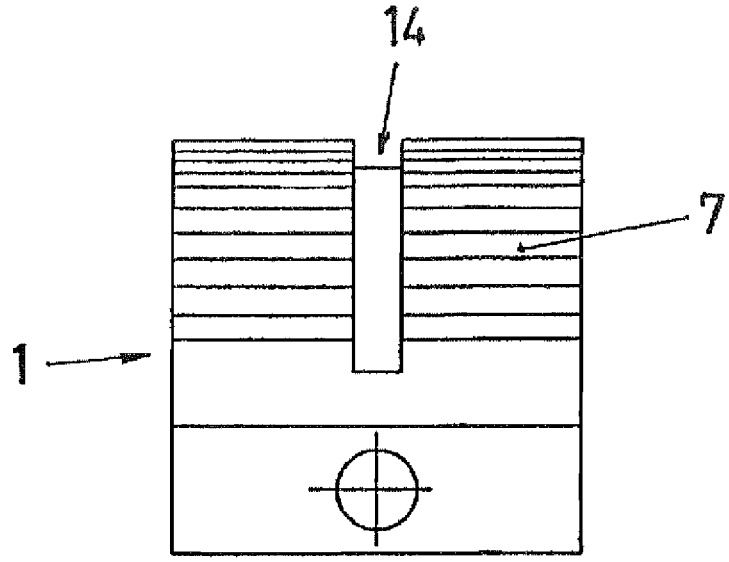
FIGS. 11 and 12 show frontal views of respective examples of the fixed jaw, with one and with two dividing grooves for dividing the toothed section.
Figure 12:
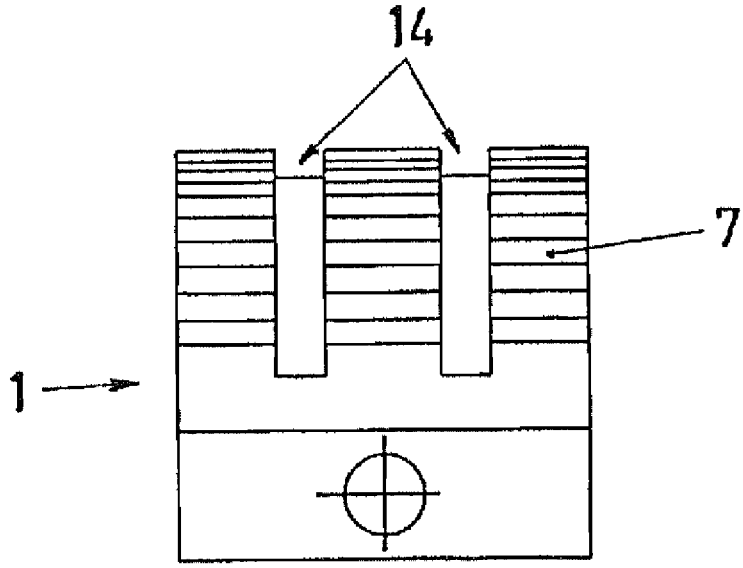

In this sense, the toothed section (7) can be provided with a dividing groove (14), such as that shown in FIGS. 10 and 11, or with two or more grooves (14), such as that shown in FIG. 12, without altering the concept of the invention.

In relation to said dividing groove or grooves (14) for dividing the toothed section (7), an accessory member can further be incorporated in the fixed jaw (1) by means of plug-in coupling to increase the ability of the wrench to act on other cylindrical elements (8) different from those theoretically corresponding to the object of application of the wrench.

The moving jaw (3) is equipped in the outer part of the area of assembly on the axis (9) with a tongue (3.1) that allows actuating the opening of the wrench by means of actuation with a finger on said tongue (3.1), said moving jaw (3) further having in the area of the assembly side recesses (3.2) in which the spring (4) is housed without projecting outside, such that said spring (4) is completely housed without the risk of sustaining catches or blows when the wrench is being used.

According to a practical embodiment, the free ends of the spring (4) are arranged in holes (12) of the recesses (3.2), whereas the other end of said spring (4) is supported against the handle (2) at the bottom of a housing (2.1) defined by said handle (2), wherein the area of assembly of the moving jaw (3) is included. This arrangement allows easily incorporating the spring (4) in the assembly arrangement since the holes (12) for the fitting of the ends are perfectly accessible.

The structural assembly of the wrench is further equipped in the rear part of the coupling area of the fixed jaw (1) with a stop (13) on which the moving jaw (3) is supported when collapsed towards the closed position, such that said stop (13) forms a limit for the pivoting of the mentioned moving jaw, preventing it from being supported against the toothed section (7) and from being able to deteriorate the teeth thereof.

The invention claimed is:

1. A set of manual wrenches for actuating cylindrical elements, the set comprising:

a plurality of wrenches, each of the wrenches having, an actuating handle;

a fixed jaw arranged on one end of the actuating handle;

a moving jaw articulated and rotatably mounted about an axis on the one end of the handle;

a spring fixed to the handle and actuating said moving jaw towards a closed position on the fixed jaw;

a toothed section on the fixed jaw;

the toothed section having teeth, each tooth thereof having a crest and the crests of the teeth determine an arc having a radius;

a center of the arc of the toothed section is located at a distance from a center of the axis of rotation of the moving jaw, wherein each of the wrenches, of the set of wrenches, has a different radius for the arc and each of the wrenches of the set of wrenches has a different distance; and the radius of each of the wrenches is between 35 millimeters and 15 millimeters, and the distance is between 20 millimeters and 57 millimeters, wherein for the plurality of wrenches in the set of wrenches, the radius of one wrench in the set is larger than the radius of a next wrench in the set and the distance of the one wrench in the set is smaller than the distance of the next wrench in the set.

2. The set of claim 1, wherein the radius of the arc of each of the wrenches is between 31 millimeters and 20 millimeters.

3. The set of claim 1, wherein the distance of each of the wrenches is between 21 millimeters and 49 millimeters.

4. The set of claim 1, wherein the toothed section of each fixed jaw has two or more longitudinal grooves dividing the teeth into separate sections.

5. The set of claim 4, wherein the moving jaw of each of the wrenches is equipped with a side recess in a coupling area and the spring is housed in said side recess.

6. The set of claim 5, wherein the rear part of the coupling area provides a supporting stop of the moving jaw, preventing contact of the moving jaw with the toothed section.

7. The set of claim 4, wherein the fixed jaw of each of the wrenches is formed by a member which is secured on the handle by means of a transverse keyed fitting, and an elastic pin which extends through the keyed fitting securely coupling the member to the handle.

8. The set of claim 7, wherein the elastic pin extends through a hole going from a front part to a rear part in a coupling area, allowing the extraction of the pin by pushing from the rear part with a rod.

9. The set of claim 1, wherein the fixed jaw of each of the wrenches is formed by a member which is secured on the handle by means of a transverse keyed fitting, and an elastic pin which extends through the keyed fitting securely coupling the member to the handle.

10. The set of claim 9, wherein the elastic pin extends through a hole going from a front part to a rear part in a coupling area, allowing the extraction of the pin by pushing from the rear part with a rod.

11. The set of claim 1, wherein the moving jaw of each of the wrenches is equipped with a side recess in a coupling area, the spring is housed in said side recess.

12. The set of claim 11, wherein the rear part of the coupling area of each of the wrenches provides a supporting stop of the moving jaw, preventing contact of the moving jaw with the toothed section.

* * * * *